US006827220B1

(12) United States Patent
Young et al.

(10) Patent No.: US 6,827,220 B1
(45) Date of Patent: Dec. 7, 2004

(54) FLOTATION OF SULFIDE MINERAL SPECIES WITH OILS

(75) Inventors: Tom L. Young, Tucson, AZ (US); Michael G. Greene, Tucson, AZ (US); Kathy Bauer, Tucson, AZ (US); Norman R. Reber, deceased, late of Tucson, AZ (US), by Bonnie J. Reber, legal representative; Sharon K. Young, Tucson, AZ (US)

(73) Assignee: Versitech, Inc., Tucson, AZ (US)

( * ) Notice: Subject to any disclaimer, the term of this patent is extended or adjusted under 35 U.S.C. 154(b) by 0 days.

(21) Appl. No.: 09/762,619

(22) PCT Filed: Aug. 9, 1999

(86) PCT No.: PCT/US99/18055

§ 371 (c)(1),
(2), (4) Date: Feb. 9, 2001

(87) PCT Pub. No.: WO00/09268

PCT Pub. Date: Feb. 24, 2000

Related U.S. Application Data

(60) Provisional application No. 60/096,175, filed on Aug. 11, 1998.

(51) Int. Cl.[7] ..... B03D 1/008; B03D 1/012; B03D 1/02

(52) U.S. Cl. ..... 209/166; 252/61

(58) Field of Search ..... 209/166, 167; 252/61

(56) References Cited

U.S. PATENT DOCUMENTS

| | | | | |
|---|---|---|---|---|
| 956,773 A | | 5/1910 | Lockwood | |
| 1,043,851 A | | 11/1912 | Lockwood | |
| 1,064,723 A | | 6/1913 | Greenway et al. | |
| 1,102,873 A | | 7/1914 | Chapman et al. | |
| 1,142,821 A | * | 6/1915 | Williams | 209/167 |
| 1,191,053 A | | 7/1916 | Yaryan | |
| 1,208,171 A | | 12/1916 | Lavers et al. | |
| 1,300,516 A | * | 4/1919 | Lavers | 209/167 |
| 1,457,680 A | | 6/1923 | Whitaker | |
| 1,894,344 A | | 1/1933 | Christmann et al. | |
| 2,014,406 A | | 9/1935 | Weed et al. | |
| 2,120,217 A | | 6/1938 | Harris | |
| 3,480,143 A | | 11/1969 | Mitzmager et al. | |
| 4,507,198 A | | 3/1985 | Unger et al. | |
| 4,518,492 A | | 5/1985 | Bresson et al. | |
| 4,589,980 A | | 5/1986 | Keys | |
| 4,678,563 A | | 7/1987 | Keys | |
| 4,857,221 A | | 8/1989 | Brookes et al. | |
| 4,859,318 A | | 8/1989 | Brookes et al. | |
| 5,223,147 A | | 6/1993 | Rosenstock et al. | |
| 5,407,080 A | | 4/1995 | Welch et al. | |
| 5,544,760 A | | 8/1996 | Benn et al. | |
| 5,795,465 A | | 8/1998 | Arbiter | |

FOREIGN PATENT DOCUMENTS

| | | |
|---|---|---|
| CL | 38802 | 2/1994 |
| GB | 565568 | * 11/1944 |
| GB | 2 093 735 A | 8/1982 |
| WO | WO 97/25149 | 7/1997 |

OTHER PUBLICATIONS

Search Report from Corresponding Chilean Patent Application No. 1809–99.
Research Disclosure No. 17314 (Sep. 1978) (abstract).
Chemical Abstracts, 107:81479, pp. 226–227, 1987.
International Search Report for International Application PCT/US99/18055, dated Nov. 18, 1999.
Written Opinion for International Application PCT/US99/18055,dated Jun. 22, 2000.

* cited by examiner

*Primary Examiner*—Thomas M. Lithgow
(74) *Attorney, Agent, or Firm*—Brinks Hofer Gilson & Lione; Gregory H. Zayia

(57) ABSTRACT

This invention is directed to the use of non-sulfur containing compounds as collectors in the froth flotation of certain mineral sulfide and metallic compounds. These non-sulfur-containing compounds may be from natural sources, such as vegetable oils, or synthesized commercial sources. These non-sulfide collectors can be used singularly, in combinations, and in mixtures with known commercial sulfur containing collectors. These non-sulfur-containing collectors are compatible with common frothers.

25 Claims, No Drawings

FLOTATION OF SULFIDE MINERAL SPECIES WITH OILS

CROSS-REFERENCE TO RELATED APPLICATIONS

This application is the National Stage of International Application No. PCT/US99/18055 filed Aug. 9, 1999, which claims the benefit of U.S. Provisional Application No. 60/096,175, filed Aug. 11, 1998, which is incorporated herein by reference.

BACKGROUND OF THE INVENTION

This invention relates to the beneficiating or concentrating of ores. In particular, this invention relates to collectors useful in ore beneficiating.

Flotation is a process for concentrating minerals from their ores. Flotation processes are well known in the art and are probably the most widely used method for recovering and concentrating minerals from ores. In a flotation process, the ore is typically crushed and wet ground to obtain a pulp. Additives such as flotation or collecting agents and frothing agents are added to the pulp to assist in subsequent flotation steps in separating valuable minerals from the undesired, or gangue, portion of the ore. The flotation or collecting agents can comprise liquids such as oil, other organic compounds, or aqueous solutions. Flotation is accomplished by aerating the pulp to produce froth at the surface. Minerals, which adhere to the bubbles or froth, are skimmed or other removed and the mineral-bearing froth is collected and further processed to obtain the desired minerals.

The basic techniques behind froth flotation is to use chemicals to increase the hydrophobicity of the mineral to be beneficiated to form a concentrate. Meanwhile, chemicals are added, as necessary, to decrease the hydrophobicity of unwanted (gangue) minerals, so that these minerals report to the slurry and are discarded as tail. The main alternative technique in froth flotation is "reverse flotation". This consists of floating the gangue minerals as a concentrate and keeping the mineral of interest on the slurry.

Chemicals that promote hydrophobicity of a mineral are called out that mineral's "promoter" or "collector." Collectors based on fatty acids have long been used in collecting one or more of the oxide minerals such as fluorspar, iron ore, chromite, scheelite, $CaCO_2$, $MgCO_2$, apatite, or ilmenite.

Also, early work used alkali metal salts of fatty acids, or soaps derived from natural oils by the process known as saponification. When an oil containing triglycerides is treated with a caustic solution under certain harsh processing conditions, the triglycerides disassociate into the alkali metal salts of the component fatty acids. The dissociation of the triglycerides into neutralized fatty acids is the saponification process. These neutralized fatty acids are soaps that act as non-selective flotation collectors.

Compounds containing sulfur, such as xanthanes, thionocarbamates, dithiophosphates, and mercaptans, will selectively collect one or more sulfide minerals such as chalcocite, chalcopyrite, galena, or sphalerite. Unfortunately, sulfur based collectors are often toxic, have repugnant odors or both. Amine compounds are used to float KCl from NaCl and for silica flotation. Petroleum-based oily compounds such as diesel fuels, decant oils, and light cycle oils, are often used to float molybdenite. Those oils are also used as an "extruderoil" that reduces the dosage of other more expensive collectors in the amine flotation of KCl.

Previous work on sulfide minerals has indicated that molecules containing sulfur are useful compounds for the froth flotation of sulfide minerals. These collectors are usually grouped into two categories: water-soluble and oil (i.e., hydrophobic) collectors. Water-soluble collectors such as xanthates, sodium salts of dithiophosphates, and mercapto benzothiazole have good solubility in water (at least 50 gram per liter) and very little solubility in alkanes. Oily collectors, such as zinc salts of dithiophosphates, thionocarbamates, mercaptans, and ethyl octylsulfide, have negligible solubility in water and generally good solubility in alkane.

Currently used collectors for most sulfide minerals are sulfur-based chemicals such as xanthanes, thionocarbamates, dithiophosphates, or mercaptans. These chemicals have problems with toxicity and or repugnant odors. In addition, these collectors can be very expensive. Therefore, a need exists for new collectors that are effective but not toxic or odiferous.

BRIEF SUMMARY OF THE INVENTION

This invention is directed to a method of beneficiating a mineral sulfide-containing material or a metallic species of gold, silver, copper, palladium, platinum, iridium, osmium, rhodium, or ruthenium by froth flotation in the presence of a collector as well as a collector for beneficiation of sulfide minerals, precipitates, or metallic species. In both aspects, the collector includes at least one oil which is either an essential oil or a natural or synthesized oil comprising triglycerides containing fatty acids of only 20 carbons or less, or an ester made from a fatty acid and an alcohol.

In the method aspect of the invention, the method includes the steps of (1) providing an aqueous slurry of the mineral sulfide-containing or metal-containing material, (2) adding a selective collector to the slurry, the collector comprising at least one oil selected from the group consisting of (a) a natural oil or synthesized oil comprising triglycerides containing fatty acids of only 20 carbons or less, or an ester made of fatty acid and an alcohol; and (b) an essential oil; (3) selectively floating the mineral sulfide; and, then (4) recovering the mineral.

In the collector aspect of the invention, a collector is provided for beneficiation of sulfide minerals or precipitates from ores, concentrates, residues, tailings, slags, or wastes. The collector includes at least one sulfur-containing sulfide mineral flotation promoter; and at least one oil selected from the group consisting of (1) a natural or synthesized oil comprising at least one triglyceride, or at least one ester made from a fatty acid and an alcohol; and (2) an essential oil.

This invention has an advantage that the specified triglyceride, specially, or essential oil will selectively float sulfide minerals by itself or mixed with other collectors. This and other advantages will be apparent from the detailed description of the invention that follows.

DETAILED DISCLOSURE OF THE INVENTION

The subject invention provides materials and methods useful in the recovery of minerals. These materials and methods are specifically applicable to froth flotation procedures; whereby, minerals are removed and recovered from complex mixtures of ores, residues, concentrates, slags, and wastes. The subject invention can be used in remediation processes to remove unwanted materials or may be used in mining processes to recover valuable minerals. Specifically exemplified herein is the use of certain triglycerides, esters of the fatty acids and long chain alcohols, and essential oils of both terpene and aromatic chemistries. Any of these oils may be used alone, in mixtures, or in combination with other collectors.

In the method aspect of the invention, the method includes the steps of (1) providing an aqueous slurry of the mineral sulfide-containing or metal-containing material, (2) adding a selective collector to the slurry, the collector comprising at least one oil selected from the group consisting of (a) a natural oil or synthesized oil comprising triglycerides containing fatty acids of only 20 carbons or less, or an ester made from a fatty acid and an alcohol; and (b) an essential oil; (3) selectively floating the mineral sulfide; and, then (4) recovering the mineral.

In the collector aspect of the invention, a collector is provided for beneficiation of sulfide materials or precipitates from ores, concentrates, residues, tailings, slags, or wastes. The collector includes at least one sulfur-containing sulfide mineral flotation promoter; and at least one oil selected from the group consisting of (1) a natural or synthesized oil comprising at least one triglyceride, or at least one ester made from a fatty acid and an alcohol; and (2) an essential oil.

Preferably the mineral sulfide-containing material selected from the group consisting of chalconine, chalcopyrine, bornite, galena, sphalerite, pentlandite, molybdenite, and other sulfide minerals containing silver, gold, platinum, palladium, iridium, rhodium, and osmium, either in the crystal structure or in association as an independent mineral species, and combinations thereof. This material may be derived from ores, concentrates, precipitates, residues, tailings, slag, or wastes.

Alternatively, the method may be used for acting upon metallic species such as gold, silver, copper, palladium, platinum, iridium, osmium, rhodium, and ruthenium by froth flotation in the presence of a collector. The metallic species may be from material derived from any ore, concentrate, residue, tailings, slag, or waste.

The oils used according to the subject invention can be readily obtained and used by a person trained in the teaching of this patent. The natural oils identified in this invention are obtained directly or indirectly from plants or animals.

In a specific embodiment, the process of the subject invention can comprise the following steps:

a) pulverizing a mineral-containing material to appropriate fine-sized particles;
b) mixing the pulverized particles with water to produce a slurry;
c) agitating the mixture and adjusting its pH as necessary to produce a conditioned slurry;
d) adding a sufficient amount of a naturally occurring oil or a mixture thereof to the slurry with conditioning to render the surfaces of the particles containing the desired minerals hydrophobic;
e) agitating the resultant slurry under conditions and for a time sufficient to obtain a sufficiently homogenous mixture;
f) adding a frothing agent to the homogenous mixture in an amount sufficient to cause frothing of the homogenous mixture upon injecting air or other gases;
g) injecting air or other gas into the mixture to form bubbles in the resultant composition in an amount and under conditions sufficient to cause the hydrophobic particles to become attached to the bubbles and cause the resultant bubbles with attached particles to rise and form forth; and
h) separating the froth fraction and recovering the desired mineral.

In a specific embodiment of the subject invention, the mixture produced in Part (b) will have between about 1% to 75% solids by weight. In Part (c) of the process, the pH may be adjusted to anywhere in the 5 to about 13 pH range, with particularly good results in the 7 to 10 pH range. With regard to Part (d), a natural oil, such as cottonseed, may be used as the only collector or it may be used with other collector compounds. In a preferred embodiment, the concentration of the natural oil used according to the subject invention can range from about 1 gram per ton of ore to about 1,000 grams per ton of ore. The temperature range of the use of these compounds goes from 5 to 75 degrees Centigrade with most normal operations in the 15 to 40 degree Centigrade range. Preferably, the flotation conditions should be kept mild enough to prevent significant disassociation of the triglycerides, or other components, contained in the natural oils into fatty acids, and to prevent the subsequent saponification into fatty acid soaps. The selectivity of the flotation when using oils according to this invention is evidenced by the selective recovery of the minerals, and substantiates this observation. A skilled artisan trained in the teachings of this patent can adjust the concentration and conditions to achieve optimization of the process for a particular mineral once a collector compound has been identified as useful for that mineral species.

Gold, silver and platinum metal group metals (platinum, palladium, rhodium, and iridium) are often associated with sulfide minerals. These metals may be also effectively collected by the oils described in this patent either alone or in combination with another collector.

The invention is specifically exemplified for the recovery of certain sulfide minerals. A skilled artisan, having the benefit of the instant disclosure, could readily adapt the process for the recovery and/or removal of a broad range of sulfide minerals, silver, gold or platinum group metals.

It was found, however, that there are unexpected benefits of using certain organic compounds containing no sulfur, no nitrogen and no phosphorous for selective froth flotation of certain sulfides. These molecules contain oxygen in a variety of functional groups such as triglycerides and esters. These groupings occur in many natural oils, such as cottonseed, corn, palm, safflower, jojoba, and clove. Surprisingly, many of these oils are non-toxic and are used in foodstuffs throughout the world. The oils run in price from $0.40 per kilogram to over $125 per kilogram.

It was also unexpected that blends of these oils with each other and with standard collectors frequently exhibit synergistic or enhanced effects, in that a mixture of a sulfur containing collector with a non-sulfur containing collector may perform better than either of the components alone, and mixtures of multiple components may perform better than a two-component blend. This invention is uniquely suited to such mineral species as chalcocite, chalcopyrite, bornite, galena, and sphalerite. However, sulfur species such as pyrite are not as readily floated by these non-sulfur-containing collectors.

Most natural plant and animal oils are triglycerides of mixtures of fatty acids. A triglyceride is simply the reaction product of a carboxylic acid and glycerol. The general formula for a triglyceride is shown in FIG. 1. Triglycerides are generally made from fatty acids with typically 10 to 24 carbon atoms and from 0 to 3 double bonds in their chains. Some triglycerides are made from hydroxyl fatty acids that have an alcohol group somewhere in the chain. An example of this is castor oil. Another oil, oiticicia, has three double bonds and a ketone functionality in its composition.

Figure 1.
General Formula for Triglyceride

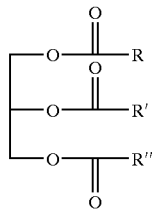

Saturated or highly saturated oils, such as coconut oil, contain triglycerides made from a zero to a low percentage of fatty acids having double bonds. Linseed oil contains a high percentage of linolenic acid oil, an 18 carbon fatty acid with three double bonds (expressed as $C_{18:3}$). The composition of some common natural oils is shown in Table 1. The iodine value is a measure of the unsaturation of the oil. The saturated fat column is for the percentage of saturated fat when the extract chain length is unspecified. A given type of oil composition will vary with the variety of plant, the growing conditions and the treatment of the oil after pressing. For instance, there are both high and low erucic acid ($C_{22:1}$) species of canola oil. Some canola oil is also hydrogenated (hydrogen reacted with the double bonds) before being sold.

It was unexpectedly found, however, that oils containing triglycerides that have fatty acids with 20 carbon atoms or less, perform much better than oils, such as canola oil, that contain triglycerides with fatty acids having 22 carbons or more, such as erucic acid ($C_{22:1}$). Moreover, since oils containing triglycerides of fatty acids with twenty carbon atoms or less do not contain free fatty acids, they do not behave as either fatty acids or soaps of fatty acids. The selective nature of these oils in flotation was surprising because fatty acids and fatty acid salts (i.e., soaps) are very non-selective.

TABLE 1

Composition of Common Vegetable Oils

| | | Fatty Acids in Triglyceride | | | | | | | |
|---|---|---|---|---|---|---|---|---|---|
| Type | Iodine Value | Saturated Fat | C6:0 | C8:0 | C10:0 | C12:0 | C14:0 | C16:0 | C18:0 |
| Coconut | 6–11 | | 0.4 | 5.2 | 5.6 | 47.0 | 19.4 | 7.5 | 4.3 |
| Palm Oil | 44–58 | | | | | | 2.0 | 42.0 | 4.0 |
| Typical | | | | | | | | | |
| Olive | 75–94 | | | | | | | 15.0 | 75.0 |
| Caster | 82–92 | | | | | | 2.0 | 1.0 | 7.0 |
| Apricot | 81–123 | | | | | | | | 5.5 |
| Corn Oil | 103–133 | | | | | | 0.2 | 11.8 | 2.0 |
| Cottonseed | 103.9 | | | | | | 1.4 | 29.8 | 3.3 |
| Soybean 1 | 120.9 | 12.0 | | | | | | | |
| Soybean 2 | 124.9 | 13.2 | | | | | | | |
| Soybean 3 | 127–140 | 12.5 | | | | | | | |
| Sunflower | 128 | | | | | | | 6.0 | 4.1 |
| Linseed | 170–204 | | | | | | | 5.5 | 3.5 |
| Lung | | | | | | | | | |
| Avocado | | | | | | | | | 14 |

| | Fatty Acids in Triglyceride | | | | | | | |
|---|---|---|---|---|---|---|---|---|
| Type | C18:1 | C18:2 | C18:3 | C20:0 | C20:1 | C22:0 | C22:1 | Alcohol C18:1 |
| Coconut | 4.3 | 1.8 | | 1.0 | | | | |
| Palm Oil | 42.0 | 10.0 | | | | | | |
| Typical | | | | | | | | |
| Olive | 10.0 | | | | | | | |
| Caster | 3.0 | | | | | | | 88.0 |
| Apricot | 66.0 | 27.0 | | | | | | |
| Corn Oil | 24.1 | 61.7 | 0.7 | | | | | |
| Cottonseed | 30.4 | 42.9 | | 0.8 | | | | |
| Soybean 1 | 60.0 | 25.0 | 2.9 | | | | | |
| Soybean 2 | 34.0 | 49.1 | 3.6 | | | | | |
| Soybean 3 | 28.6 | 52.8 | 6.8 | | | | | |
| Sunflower | 24.4 | 64.3 | | | | | | |
| Linseed | 19.1 | 15.3 | 57.0 | | | | | |
| Tung | | | 85 | | | | | |
| Avocado | 70 | 15 | 1 | | | | | |

Other sources of triglycerides are animal oils. Commercially available animal oils have a limited range of unsaturation values. A highly unsaturated lard oil will have triglycerides containing 46% $C_{1\times1}$(oleic acid). 15% $C_{1\times2}$ (linoleic acid). 1% $C_{1\times2}$(linolenic acid), and 62% saturated fatty acids.

There are some unique natural oils. Sperm whale oil contains esters made from long chain fatty acids and long chain fatty alcohols instead of esters of the fatty acid and glycerol as in triglycerides. Both the fatty acid and long chain alcohol usually contain at least 1 double bond. Sperm whale oil is, of course, no longer available due to whaling restrictions. However, its replacements, jojoba oil (vegetable) and orange roughy oil (fish), have the same basic chemistry as sperm whale oil. The only differences between them are in the carbon numbers (chain length) of the various components of the oils.

Chemical manufacturers can synthesize a long chain ester from a fatty acid and a long chain alcohol. One example of a "synthesized oil" or "synthetic oil" is 2-butyloctyl oleic acid ester. This compound contains one unsaturated site in the fatty acid molecule. The carbon numbers of the largest fractions of these oils are shown in Table 2.

TABLE 2

Carbon Numbers of Major Components of Specialty Oils

| | % of Material of Specified Carbon Number | | | | | | | |
|---|---|---|---|---|---|---|---|---|
| Oil | 30 | 32 | 34 | 36 | 38 | 40 | 42 | 44 |
| Sperm Whale | 21 | 23 | 20 | 12 | | | | |
| Jojoba | | | | | 6 | 31 | 50 | 8 |
| Orange Roughy | | | 11 | 16 | 25 | 23 | 15 | 5 |
| 2-butyloctyl oleic acid ester | | 100 | | | | | | |

Preferably, the natural oils used in this invention include triglycerides that contain only fatty acids having a carbon number less than 20. Also, it is preferred that the triglycerides include an alcohol, an ether, an aldehyde, or a ketone functional group, or an aromatic group. A preferred group of natural oils includes cottonseed, corn, linseed, rice bran, safflower, soybean, avocado, jojoba, menhaden, lard, castor, cod liver, tung, oiticicia, apricot, sunflower pistachio, herring, and coconut oils. A more preferred group of natural oils includes cottonseed, corn, linseed, rice bran, safflower, soybean, avocado, jojoba, menhaden, lard, castor, cod liver, tung, and oiticicia. A still more preferred group of natural oils includes cottonseed, corn, linseed, rice bran, safflower, soybean, avocado, jojoba, menhaden, lard, and castor oils. An even more preferred group of natural oils includes cottonseed, corn, linseed, rice bran, safflower and soybean. The most preferred natural oil is cottonseed oil.

Another class of naturally occurring oils is called "essential oils" or "volatile oils." These are fragrant oils derived from various plant species. Since ancient Egyptian times, they have been used for their fragrance and reputed medicinal properties. The chemistry of most of these compounds is based on either terpene chemistry or aromatic chemistry.

Terpenes are defined as compounds that can be assembled from two or more molecules of isoprene ($C_5H_8$) and the alcohol, aldehyde, and ketone derivatives of such compounds. A terpene compound can be defined as a monoterpene, sesquiterpene, or diterpene compound based on whether it contains 2, 3, or 4 isoprene units, respectively. Within each of these classifications the compounds can be further defined as being acyclic, monocyclic, bicyclic or tricyclic depending on whether the terpene contains, respectively, 0, 1, 2, or 3 ring structures (only diterpenes are tricyclic). Tricyclic diterpenes are generally solids.

Aromatic chemistry for essential oils refers to the chemistry of derivatives of benzene. The two most common aromatic components of essential oils are cinnamaldehyde and eugenol. These are obtained from cinnamon and clove oil. Their structures are shown in FIG. 2.

Figure 2.
Structure of Eugenol and Cinnamaldehyde

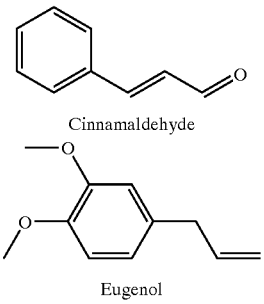

Most essential oils have one single major terpene or aromatic component or are a mixture of closely related terpenes or aromatics. Table 3 shows the composition of some representative essential oils. Note that any particular oil's composition can vary with variety, weather, etc.

TABLE 3

Major Constituent of Representative Essential Oils

| | | Major Component | | |
|---|---|---|---|---|
| Oil | Plant Source | Name | % | Chemical Family |
| Citronella | *Cymbopogon winterianus* | Citronellal: | 33 | Aldehyde and |
| | | Citronellol: | 16 | Alcohols of acyclic |
| | | Geraniol: | 24 | monoterpene |
| Limonene | Citrus (Orange) | Limonene | 95 | Monocyclic monoterpene |
| Eucalyptus | *Eucalyptus globus* | Cinole | 90 | Bicyclic monoterpene ether |
| Sandalwood | Sandalwood | Mixture | 80 | Sesquiterpenes |
| Clove | Clove | Eugenol | 85 | Aromatic |

Preferably, the essential oils used in the methods of this invention include either a terpene compound or an aromatic compound. More preferably, the essential oil includes a terpene derivative having a functional group selected from an alcohol, an ether, an aldehyde, and a ketone. Specific preferred essential oils include limonene, citronella, eugenol, eucalyptus globus, camphor, and clove oil. A more preferred group of essential oils includes limonene and citronella.

As work with the triglycerides, esters and alcohols have indicated, other oxygen-containing compounds such as aldehydes, ketones, and ethers of sufficient carbon number to be water-insoluble function as collectors for sulfide minerals. These compounds may or may not have carbon-carbon double bond(s).

The literature has shown that emulsified collectors can give better results than unemulsified collectors. Emulsification should also allow the combining of inexpensive water-soluble xanthates and sodium sulfide into the oils. Other water-soluble collectors that may be amenable to emulsification into oil include sodium dithiophosphates and mercapthobenzothiazole.

The invention also includes the use of the plant and animal oil collectors blended with known commercial collectors. Commercial collectors are also known as "flotation promoters" and are identified herein as "sulfur-containing flotation promoters." These common commercial promoters are usually separated into two classes of chemicals based on their water solubility. Water soluble sulfur containing collectors, or promoters, used in the froth flotation of sulfide minerals include such well-known collectors as xanthates and dithiophosphates. These are usually used as sodium or potassium salts of the respective organic acids. An example of a water-soluble collector would be sodium isopropyl xanthate. The other class of sulfur containing collectors would be water insoluble collectors. These collectors are generally referred to as oil collectors, because they are liquids that are insoluble in water. These collectors include thionocarbamates, mercaptans, organic sulfides, and the zinc salts of dithiophosphates. Even though these compounds are chemical reaction products, they are called oils.

Another grouping of collectors commonly used in froth flotation of substances such as coat, sulfur, and molybdenite are petroleum-based products that are truly oils. These oils generally consist of kerosene, vapor, diesel, fuel, turbine, light cycle, and carbon black oil. These petroleum oils are generally called "extender oils" are generally exhibit poor collecting ability and very poor selectivity when used by themselves. To distinguish these "petroleum-based collectors" from other described collectors, the term "oil collector" used in this text means a synthesized organic chemical compound containing sulfur such as the group of "sulfur-containing flotation promoters" described above.

This invention also includes the use of any of these aforementioned natural, synthetic or essential oils in combination. The essential oils are found to be very potent collectors. As such they are ideally suited for use in small amounts in combination with other oils or with other sulfide-containing flotation promoters. Good results have been obtained when using the essential oils in amounts of less than 10% weight blended with other collectors. Preferably, less than 2% by weight is used.

Also, any of the natural oils including the higher carbon fatty acid-containing triglycerides, and in particular, the preferred natural oils alone or in combination with other preferred oils, may be used blended with any number of sulfur-containing flotation promoters. In such blends, the natural oils make up preferably between 20% and 80% by weight of the blend, and the flotation promoters make up preferably between the remaining 80% and 20% by weight of the blend. Optionally, a frother may be added to that blend, preferably in an amount between about 10% and 40% by weight of the composition. Frothers are commercially available compositions that are used to develop a froth or foam on top of a slurry that has been aerated. A particular suitable frother is one such as that sold by NALCO under the designation 9743. Methyl isobutyl carbonol (MIBC), also known as methyl amyl alcohol, is one of the most widely used frothers in the mining industry.

The collectors and blends of collectors in accordance with the methods of this invention can be used in standard froth flotation processes known by those skilled in the art and modified by the teachings of this patent as illustrated in the following examples.

EXAMPLES

The following examples that illustrate procedures for practicing the invention. These examples should not be construed as limiting the invention, but are provided to further illustrate the teachings of the invention. All percentages are by weight and all collector mixture proportions are by volume unless otherwise noted.

Example I

This example illustrates the effectiveness of cottonseed oil as a collector for molybdenite and calcopyrite. The ore had a head grade of 0.259% Cu and 0.0064% Mo. The ore charge of 1.0 kilogram was ground at 60% solids to 60% passing (P60) a 150 micron (100 mesh) screen. The ground ore slurry was adjusted to a pH of 10.5 with lime. The ore was ground with 10 gram/top (0.020 pound/ton) of secondary collector. A Denver laboratory flotation machine was used. The ore slurry charge was diluted with water to 29 percent solids, and 6 grams per ton of the main collector, sodium ethyl xanthate, and 25 gram/ton (0.05 pound/ton) of the OrePrep F-533 frother were added. The flotation was carried out for a total of six minutes with a two minute break for conditioning at the halfway point. During the conditioning break, 4 gram/ton dosage of the sodium ethyl xanthate was added.

The cottonseed oil was used by itself in place of the standard decant oil-light cycle oil-mercaptan (tertiary dodecyl mercaptan) secondary collector. Also, a 33% each mixture of cottonseed oil, zinc di (1,3 dimethylbutyl) dithiophosphate, and the tertiary dodecyl mercaptan was tested. For comparison a 33% each mixture of decant oil, the zinc dithiophosphate and the mercaptan was tested. The dosage of the main and secondary collector was 10 grams collector per ton of ore (g/t) for all tests. As shown in Table 4, cottonseed oil by itself improved the recovery of both molybdenum recovery and copper grade over the standard collector. The cottonseed mixture had a similar copper recovery as the decant oil mixture while improving copper grade.

TABLE 4

Chalcopyrite Ore containing $MoS_2$ Flotation

| Main Collector | Secondary Collector | Cu Recovery | Cu Grade | Mo Recovery |
|---|---|---|---|---|
| Xanthate | Cottonseed Oil | 94.5% | 3.68 | 82.2% |
| Xanthate | Standard | 93.9% | 2.96 | 79.1% |
| Xanthate | Decant Oil Mixture | 97.0% | 2.85 | 87.3% |
| Xanthate | Cottonseed Mixture | 96.2% | 4.25 | 83.7% |

Example II

This example shows that cottonseed oil can be used to collect some galena (PbS). It can be used either alone in place of the main collector, sodium isopropyl xanthate, or in a mixture with a mercaptan (tertiary dodecyl mercaptan) collector in place of the main collector.

The ore was ground to a P80 of around 240 microns. The ore charge was 2.0 kilograms and had a head assay of 70 gram/ton Ag. 0.70% Pb, and 1.32% Zn. Fifty gram/ton of zinc sulfate and fifteen gram/ton of dextrin were added to the grind. The floatation was conducted in a Denver laboratory flotation machine with a 5-liter cell. The float was conducted at the natural pH of the ore, 7.5 to 8. Before the first float, the slurry was conditioned with 30 gram/ton of the collector and 80 gram/ton of the frother for two minutes. The ore was floated for three minutes, then conditioned with 10 gram/ton collector and 16 gram/ton of frother. The results are shown in Table 5, and demonstrate the enhanced effects for a blend of the natural oil and the mercaptan flotation promoter in comparison to the use of each alone.

TABLE 5

Lead-Zinc-Silver Sulfide Ore Flotation for Lead

| | Grade | | Recovery into Pb Concentrate | | | | |
|---|---|---|---|---|---|---|---|
| Collector | Pb | As | Weight | Ag | Pb | Zn | Fe |
| Xanthate | 2.18 | 1.23 | 23.6% | 74.9% | 79.5% | 18.0% | 82.9% |
| Cotton-seed Oil | 6.38 | 0.49 | 5.1% | 51.4% | 50.6% | 17.2% | 15.7% |
| Mercaptan | 7.08 | 0.76 | 5.7% | 42.9% | 49.1% | 19.3% | 14.7% |
| 50% Mercaptan + 50% Cotton-seed | 3.21 | 0.78 | 13.8% | 53.9% | 64.5% | 21.1% | 38.6% |

The ore was then conditioned for two minutes with 125 grams per ton of copper sulfate. A further 10 gram/ton of collector and 32 gram/ton of frother were added and conditioned in for two minutes. The first zinc float was conducted for three minutes. Finally, another 50 gram/ton of frother was added. The results of these zinc floats are shown in Table 6.

TABLE 6

Lead-Zinc-Silver Sulfide Ore Flotation for Zinc

| | Grade | Recovery into Zn Concentrate | | | | |
|---|---|---|---|---|---|---|
| Collector | Zn | Weight | Ag | Pb | Zn | Fe |
| Xanthate | 8.63 | 9.5% | 16.5% | 7.1% | 42.1% | 6.3% |
| Cottonseed Oil | 9.13 | 6.6% | 13.9% | 20.4% | 48.1% | 10.1% |
| Mercaptan | 12.20 | 5.6% | 16.7% | 19.8% | 46.4% | 6.2% |
| 50% Mercaptan + 50% Cotton-seed | 11.54 | 5.0% | 9.1% | 7.1% | 45.6% | 3.8% |

Example III

Apricot, sunflower, pistachio, cottonseed, and jojoba oils were tested on chalcopyrite ore containing molybdenum sulfide. The head assays of the ore were 0.704% Cu and 0.0119% Mo. The ore charge of 2.0 kilograms were ground at 65% solids to 90% passing a 212 micron (65 mesh) screen. The ore charge was diluted with water to 27% solids and placed in a Denver laboratory floatation cell. The ore was conditioned for two minutes by agitation at 2000 rpm. The ore was floated for one minute by allowing air to be drawn in by the impeller. Subsequently, the ore was conditioned for two minutes, floated for two minutes, conditioned for two minutes, and finally floated for three minutes. The standard collector is a mixture of 33% of the allyl ester of isopropyl xanthate, 33% of 2-ethylhexanol and 33% of sodium diisobutyl di-thiophosphate collector.

The standard reagent addition is as follows. Enough lime is added to the ball mill to adjust to a pH of 10.4. At the same time, 7.7 gram/ton (0.0154 pound/ton) of the standard collector or oil being tested. 7.5 gram/ton (0.0150 pound/ton) of diesel fuel are added. During the first conditioning step, 20 g/t (0.040 lb/ton) of frother is added. During the second conditioning step, 8 g/t (0.016 pound/ton) of sodium isopropyl xanthate (SIPX), 2.5 g/t (0.005 lb/t) of frother, and 5 g/t (0.010 lb/ton) of the standard reagent or oil are added. During the third and final conditioning step, 4 g/t (0.008 lb/ton) of SIPX, (0.005 lb/t) of frother and 5 g/t (0.010 lb/ton) of the standard reagent or oil are added.

The results for the final combined concentrates are presented in Table 7, sorted by copper recovery. Every oil listed above the sunflower oil gave essentially the same copper and molybdenum recovery as the standard reagent.

TABLE 7

Chalcopyrite Ore containing $MoS_2$ Flotation

| Tested Oil | Cu Grade | Recovery Cu | Recovery Mo |
|---|---|---|---|
| Standard | 5.04 | 92.4% | 84.6% |
| Cottonseed | 3.62 | 91.9% | 84.4% |
| Pistachio | 2.92 | 91.9% | 88.3% |
| Sunflower | 2.97 | 91.8% | 84.7% |
| Apricot | 2.70 | 91.7% | 79.6% |
| Jojoba | 2.69 | 91.5% | 86.5% |

Example IV

There are two primary types of cotton in the United States. Pima long staple cotton and short staple cotton. The oils derived from both were tested on a copper-molybdenum ore with a head grade of 0.663% Cu and 0.134% Mo. The ore was floated as in Example III. The results of the test shown in Table 8.

TABLE 8

Comparison of Cottonseed Oils

| Cottonseed | Grade | Recovery | |
|---|---|---|---|
| Oil Source | Cu | Cu | Mo |
| Pima Long Staple | 5.36 | 94.8% | 84.7% |
| Short Staple | 5.23 | 90.9% | 83.9% |
| Standard Collector | 5.76 | 90.6% | 82.1% |

Example V

This example shows the selectivity of cottonseed against calcite. Pure calcite crystals were crushed and screened for the fraction passing a 355 micron (42 mesh) screen. A sample size of 812 grams were obtained. The sample was slurried in a 2.5 liter cell of a Denver laboratory flotation machine. The ore was conditioned for two minutes with 123 gram/ton cottonseed oil and 26.2 gram/ton frother. The slurry was floated for two minutes and then conditioned again for two minutes with 61.5 gram/ton cottonseed oil and 10.5 gram/ton frother. The slurry was floated again for two minutes. During both flotations, a slime-stabilized froth was obtained. The results of the test are shown in Table 9.

TABLE 9

Recovery of Calcite from Pure Calcite Sample Float

| Concentrate | Recovery |
|---|---|
| 1 | 10.70% |
| 2 | 1.88% |
| Combined | 12.58% |

Example VI

This example shows cottonseed's selectivity against silica. Pure quartz crystals were crushed and screened for the fraction passing a 150 micron (100 mesh) screen. A sample size of 1000 grams were obtained. The sample was slurried in a 2.5 liter cell of a Denver laboratory flotation machine. The ore was conditioned for two minutes with 123 gram/ton cottonseed oil and 26.2 gram/ton frother. The slurry was floated for two minutes and then conditioned again for two minutes with 61.5 gram/ton cottonseed oil and 10.5 gram/ton frother. The slurry was floated again for two minutes. During both floatations, a small amount of slime-stabilized froth was obtained. The total recovery was less than 2% of the total silica.

Example VII

A number of triglyceride, specially, and essential oil collectors were tested on chalcopyrite ore containing molybdenite. The head assays of the ore were 0.579% Cu and 0.010% Mo. The ore charge of 1.0 kilograms was ground at 65% solids to 90% passing a 212 micron (65 mesh) screen.

The standard flotation procedure was as follows. Enough lime (0.9 grams) was added to the grind for the flotation slurry to have a pH of 10.4. The following reagents were added to the grind, 5.5 gram/ton of the standard thiophosphate copper collector, 7.7 gram/ton of diesel fuel, molybdenum collector, and 10 gram/ton of Nalco 9743 frother. A Denver laboratory flotation cell was used. The ore charge was diluted with water to 27% solids. The ore was floated for two minutes. The slurry was then conditioned for one minute with 6.5 gram/ton of frother and 8 gram/ton of sodium isopropyl xanthate. The slurry was floated for two more minutes, then conditioned for one more minute with half of the dosage of the previous conditioning step, and floated for a final three minutes. All concentrates were collected into one pan for a single concentrate for the whole flotation.

The oils were tested by using them as the only collector. Only lime, 10 grams/ton of frother and 24 gram/ton of the oil being tested were added to the grind. No xanthate or other collector was added to the conditioning step, only the listed frother dosage.

The results for the triglyceride tests are presented in Table 10. As tested, no triglyceride was as good a collector for copper as the standard collector system. Due to the low molybdenum grade of the head ore, molybdenum recoveries often have a large standard deviation in repeated tests on the same ore. Generally, compounds that show a 5% better recovery than another compound in single tests will have an average higher molybdenum recovery on multiple tests.

TABLE 10

Results of Triglycerides Flotation

| | Number of Double Bonds, % | | | | | Assay Con | | Recovery | |
|---|---|---|---|---|---|---|---|---|---|
| Collector | 0 | 1 | 2 | 3 | 5 | Cu | Mo | Cu | Mo |
| Standard | | | | | | 4.94 | 0.071 | 88.3% | 79.2% |
| Cottonseed | 27 | 30 | 43 | 0 | | 3.82 | 0.063 | 87.3% | 84.7% |
| Lard Oil | 31 | 48 | 12 | 1 | | 5.61 | 0.094 | 85.4% | 80.9% |
| Corn | 13 | 29 | 57 | 1 | | 5.64 | 0.084 | 85.3% | 81.6% |
| PBO Lard | 38 | 46 | 15 | 1 | | 5.01 | 0.082 | 85.2% | 83.4% |
| Linseed | 9 | 19 | 15 | 57 | | 4.91 | 0.080 | 85.1% | 80.2% |
| Tung | | | | 85 | | 5.71 | 0.088 | 85.1% | 78.2% |
| Menhaden | 18 | 18 | 37 | 13 | 14 | 8.52 | 0.144 | 84.5% | 80.7% |
| Safflower | 21 | | 79 | | | 3.75 | 0.071 | 84.2% | 83.9% |
| Herring | 14 | 49 | | | 23 | 7.88 | 0.122 | 84.0% | 78.9% |
| Avocado | | 70 | 15 | 1 | | 6.38 | 0.111 | 84.0% | 85.0% |
| Oiticicia[1] | | | | 75 | | 4.63 | 0.074 | 83.8% | 78.2% |
| Soybean | 16 | 24 | 54 | 7 | | 5.14 | 0.094 | 83.7% | 80.2% |

TABLE 10-continued

Results of Triglycerides Flotation

| | Number of Double Bonds, % | | | | | Assay Con | | Recovery | |
|---|---|---|---|---|---|---|---|---|---|
| Collector | 0 | 1 | 2 | 3 | 5 | Cu | Mo | Cu | Mo |
| Peanut | 15 | 45 | 40 | 0 | | 8.33 | 0.142 | 82.8% | 81.3% |
| Castor[2] | 12 | 88 | | | | 7.20 | 0.122 | 82.2% | 77.9% |
| Canola | 8 | 59 | 22 | 11 | | 8.43 | 0.130 | 82.0% | 80.6% |
| Rice Bran | 64 | 2 | 32 | 2 | | 8.02 | 0.142 | 81.5% | 78.7% |
| Coconut | 94 | 4 | 2 | | | 7.38 | 0.133 | 74.1% | 75.0% |

Notes:
[1]Has a ketone functionality:
[2]has a alcohol functionality

The results of the testing of specialty and essential oils are shown in Table 11. The bicyclic compounds equaled or surpassed the standard for copper and molybdenum recovery.

TABLE 11

Results of Specialty and Essential Oil Testing

| | | Grade | | Recovery | |
|---|---|---|---|---|---|
| Oil | Chemical Family | Cu | Mo | Cu | Mo |
| *Eucalyptus globus* | Bicyclic Ether | 5.25 | 0.088 | 88.8% | 87.8% |
| Standard | Thiophosphate | 4.94 | 0.071 | 88.3% | 79.2% |
| Camphor | Bicyclic Ketone | 5.32 | 0.082 | 87.9% | 85.7% |
| 2-butyloctyl oleic acid ester | Mono-unsaturated Ester | 5.62 | 0.092 | 87.3% | 86.0% |
| Jojoba | Di-unsat. Ester | 5.11 | 0.088 | 85.7% | 84.8% |
| Limonene | Cyclic monoterpene | 4.87 | 0.082 | 84.7% | 81.2% |

Example VIII

A number of triglycerides, specialty, and essential oil collectors were tested on a molybdenum sulfide ore. The head assay of the ore was 0.0638% Mo. The ore charge of 1.0 kilogram was ground at 65% solids to 90% passing a 425 micron (35 mesh) screen.

The flotation procedure is as follows. The 100 gram/ton of oil was added to the grind. A Denver laboratory flotation cell was used. The ore charge was diluted with water to 27% solids. To the two minute conditioning step, 40 g/t frother was added. The ore was floated for 1 minute. The slurry was then conditioned for one minute, floated for two minutes, conditioned for one minute, and finally floated for six minutes. Each concentrate was collected separately and assayed separately. One test was conducted with frother alone to test the free flotability of the ore. The standard collector used at the mine was diesel fuel.

The results of the flotation of molybdenum sulfide for the triglycerides are shown in Table 12. The percentage of fatty acids in the triglycerides with the shown number of double bonds is listed. All of these oils did better than the free-flotability test.

TABLE 12

Results of Triglycerides on Molybdenum Recovery

| | Number of Double Bonds, % | | | | | 1st Concentrate | | Overall | |
|---|---|---|---|---|---|---|---|---|---|
| Collector | 0 | 1 | 2 | 3 | 5 | Grade | Recovery | Grade | Recovery |
| Oiticicia[1] | | | | 75 | | 2.19 | 68.9% | 0.892 | 72.5% |
| Peanut | 15 | 45 | 40 | 0 | 0 | 1.15 | 57.9% | 0.602 | 71.9% |
| Coconut | 94 | 4 | 2 | | | 9.42 | 60.1% | 1.355 | 67.5% |
| Menhaden | 18 | 18 | 37 | 13 | 14 | 4.14 | 59.0% | 0.938 | 66.8% |
| Pfau IJJ | 31 | 48 | 12 | 1 | | 3.11 | 54.9% | 0.736 | 64.9% |
| Rice Bran | 64 | 2 | 32 | 2 | | 2.21 | 48.7% | 0.763 | 61.4% |
| Cotton-seed | 27 | 30 | 43 | 0 | | 4.44 | 51.1% | 1.084 | 60.1% |
| Tung | | | | 85 | | 3.57 | 54.8% | 0.989 | 59.1% |
| Sunflower | 12 | 24 | 64 | | | 3.21 | 48.8% | 0.736 | 58.1% |
| None | 0 | 0 | 0 | 0 | 0 | 3.38 | 53.9% | 0.870 | 57.8% |
| Corn Oil | 31 | 48 | 12 | 1 | | 4.15 | 54.2% | 1.013 | 57.7% |
| Linseed | 9 | 19 | 15 | 57 | | 2.61 | 48.4% | 0.570 | 56.2% |
| Diesel | 0 | 0 | 0 | 0 | 0 | 1.38 | 53.3% | 0.565 | 56.1% |

Notes:
[1]Has a ketone functionality

The results of specialty and essential oils are shown in Table 13. All of these oils did better than the free-flotability test.

TABLE 13

Results of Testing Specialty and Essential Oils on Molybdenite

| | | First Concentrate | | Overall | |
|---|---|---|---|---|---|
| Collector | Type | Grade | Recovery | Grade | Recovery |
| 2-butyloctyl oleic acid ester[1] | Mono-unsaturated Ester | 0.73 | 71.6% | 0.589 | 80.2% |
| Jojoba | Di-unsat. Ester | 0.96 | 68.5% | 0.507 | 78.1% |
| Clove Oil | Aromatic | 2.08 | 73.5% | 0.817 | 77.9% |
| limonene oil | Cyclic monoterpene | 2.24 | 75.0% | 0.902 | 76.7% |
| Citronella | Acylic monoterpenes | 2.00 | 69.8% | 0.598 | 74.6% |
| *Eucalyptus. globus* | Bicyclic Ether | 2.77 | 67.0% | 0.759 | 71.6% |

TABLE 13-continued

Results of Testing Specialty and Essential Oils on Molybdenite

| | | First Concentrate | | Overall | |
|---|---|---|---|---|---|
| Collector | Type | Grade | Recovery | Grade | Recovery |
| Camphor | Bicyclic Ketone | 4.41 | 61.0% | 1.056 | 64.9% |
| None | | 3.38 | 53.9% | 0.870 | 57.8% |
| Diesel | | 1.38 | 53.3% | 0.565 | 56.1% |

Note:
[1]Oil synthesized from natural products and used as a sperm whale oil replacement

Example IX

In this example the synergistic effect of various oils and a sodium isopropyl xanthate is shown. A chalcocite ore with a head assay of 0.602% Cu and 0.016% Mo was used. The ore charge of 1.0 kilogram was ground at 65% solids to 90% passing a 212 micron (65 mesh) screen.

The standard flotation procedure is as follows. Enough lime (1.9 grams) was added to the grind for the flotation slurry to have a pH of 10.8. To this grind 30 g/ton (0.060 lb/ton) of either the standard collector. Cytec S-8399, believed to be a blend of dithiophosphate and thionocarbamate available from Cytex, Inc., Wayne, N.J., U.S.A., or the natural oil collector being tested was added. The grind charge was transferred to a Denver laboratory flotation cell. The ore charge was diluted with water to 27% solids. The ore was conditioned for two minutes with 20 gram/ton of Oreprep F-533, a blended alcohol frother. The ore was floated for three minutes. The slurry was then conditioned for three minutes with 10 gram/ton of frother and 1.5 gram/ton of sodium isopropyl xanthate (SIPX). The slurry was floated three more minutes. The concentrates were collected separately except for the avocado oil and Cytex S-8399.

The results shown in Table 14. These results show that limonene oil has the best synergy with SIPX despite not collecting much chalcocite by itself as shown in the recovery in the first concentrate (1st Con). All the oils performed better as a secondary collector than the regular thiophosphate based Cytec S-8399.

TABLE 14

Results of Tests with Oils and SIPX

| | Overall | | | 1st Con | | | | |
|---|---|---|---|---|---|---|---|---|
| | Copper | | Mo | Copper | | Mo | Calc Head | |
| Collector | Grade | Recovery | Recovery | Grade | Recovery | Recovery | Cu | Mo |
| Limonene | 5.50 | 92.2% | 71.7% | 2.02 | 9.98% | 59.00% | 0.599 | 0.0162 |
| Safflower | 5.23 | 92.2% | 68.2% | 1.11 | 6.26% | 55.24% | 0.604 | 0.0168 |
| Coconut | 5.77 | 92.1% | 72.2% | 1.95 | 8.67% | 49.50% | 0.608 | 0.0179 |
| Eucalyptus | 6.00 | 92.0% | 65.9% | 2.48 | 8.09% | 39.14% | 0.619 | 0.0154 |
| Avocado | 5.63 | 91.9% | 65.9% | | | | 0.660 | 0.0157 |
| Corn | 4.90 | 91.9% | 69.0% | 2.13 | 11.42% | 52.23% | 0.571 | 0.0164 |
| Cottonseed | 5.57 | 91.7% | 71.0% | 2.76 | 12.66% | 56.19% | 0.590 | 0.0165 |
| Tung | 4.83 | 91.2% | 67.1% | 1.39 | 4.61% | 42.21% | 0.604 | 0.0167 |
| S-8399 | 3.69 | 90.6% | 69.5% | | | | 0.599 | 0.0148 |

Example X

In this example, the various combinations of oils and standard collectors are shown. A chalcocite ore with a head assay of 0.543% Cu and 0.014% Mo was used. The ore charge of 1.0 kilograms was ground at 65% solids to 90% passing a 212 micron (65 mesh) screen.

The standard flotation procedure was as follows. Enough lime (1.9 grams) was added to the grind for the flotation slurry to have a pH of 10.8. To this grind 30 g/ton (0.060 lb/ton) of either the standard collector. Cytec S-8399, or the natural oil collector being tested was added. The grind charge was transferred to a Denver laboratory flotation cell. The ore charge was diluted with water to 27% solids. The ore was conditioned for two minutes with 20 gram/ton or Oreprep F-533 frother. The ore was floated for three minutes. The slurry was then conditioned for two minutes with 1.5 gram/ton of sodium isopropyl xanthate (SIPX). The slurry was floated three more minutes.

The mixtures tested are shown in Table 15. The mercaptan used was tertiary dodecyl mercaptan. The zinc dithiophosphate used was zinc di-(1,3-dimethylbutyl)-dithiophosphate. The thionocarbamate used was n-ethyl, o-isopropyl thionocarbamate.

TABLE 15

Composition of Mixture Tested

| Collector | Staple Type of Cotton-seed | Percentage of Cotton-seed | Mer-cap-tan | Zinc dithio-phosphate | Thiono-carbamate | Glycol Still Bottoms |
|---|---|---|---|---|---|---|
| Mixture 1 | Pima | 40 | 40 | 10 | 10 | 0 |
| Mixture 2 | Long Short | 40 | 40 | 10 | 10 | 0 |
| Mixture 3 | Short | 20 | 20 | 20 | 20 | 20 |
| Mixture 4 | Short | 50 | 10 | 30 | 10 | 0 |

The results of the flotation tests are summarized in Table 16. The results show that cottonseed interacts well with the mercaptan, zinc dithiophosphate and thionocarbamate collectors.

TABLE 16

Test results for Various Mixtures

| | Overall Results | | | Calc. Head | |
|---|---|---|---|---|---|
| Collector | Grade | Cu | Mo | Cu | Mo |
| Mixture 3 | 4.48 | 90.4% | 72.1% | 0.532 | 0.0144 |
| Mixture 1 | 4.99 | 89.6% | 69.4% | 0.562 | 0.0144 |

TABLE 16-continued

Test results for Various Mixtures

| | Overall Results | | | Calc. Head | |
|---|---|---|---|---|---|
| Collector | Grade | Cu | Mo | Cu | Mo |
| Mixture 2 | 5.48 | 88.8% | 67.8% | 0.544 | 0.0142 |
| S-8399 | 4.88 | 88.6% | 65.0% | 0.525 | 0.0137 |
| Mixture 4 | 5.75 | 88.1% | 67.9% | 0.583 | 0.0142 |

Example XI

Pure mineral samples of chalcopyrite, chalcocite and galena were floated with cottonseed and limonene oils.

The flotation procedure was as follows: 500 gram charges of mineral were crushed to minus 1.7 millimeter (10 mesh) then ground with 50 gram per ton of collector to around 90% passing 212 micron (65 mesh). A charge was then placed in a Denver laboratory flotation cell with enough water to make the slurry 27% by weight solids. The slurry was then conditioned with 18 grams/ton of an alcohol frother for two minutes. The ore was floated for two minutes. The slurry was then conditioned for one minute and floated for thee minutes. Each concentrate was collected and weighed separately. One test was conducted with frother alone to test the free flotability of the mineral. The results are shown below.

TABLE 17

Results of Pure Mineral Flotation

| | Chalcocite | | | Chalcopyrite | | | Galena | | |
|---|---|---|---|---|---|---|---|---|---|
| Collector | Con 1 | Con 2 | Total | Con 1 | Con 2 | Total | Con 1 | Con 2 | Total |
| None | — | 1.20% | 1.20% | 4.90% | 3.31% | 8.20% | 18.98% | 2.55% | 21.54% |
| Cottonseed | 2.51% | 1.87% | 4.38% | 58.75% | 5.74% | 64.49% | 90.95% | 5.57% | 96.52% |
| Limonene | 3.59% | 2.05% | 5.64% | 19.15% | 4.70% | 23.85% | 18.53% | 2.07% | 20.60% |

The cottonseed oil collected a good proportion of the pure mineral chalcopyrite. Comparing the results of cottonseed on chalcopyrite to the results of the "no collector" test shows that the cottonseed was responsible for collecting the chalcopyrite and that it is a better collector than the limonene oil.

Of course, it should be understood that changes and modifications can be made to the preferred embodiments described above without departing from the scope of the present invention. It is therefore intended that the foregoing detailed description be regarded as illustrative rather than limiting, and that it be understood that it is the appended claims including all equivalents, which are intended to define the scope of this invention.

What is claimed is:

1. A method for beneficiation of a mineral sulfide-containing material by air-injection froth flotation in the presence of a collector, the method comprising:

a) providing an aqueous slurry of the mineral sulfide-containing material;

b) adding a selective collector to the slurry in an amount less than about 100 g/ton of the mineral sulfide-containing material, the collector comprising:

at least one oil selected from the group consisting of:

1) a natural oil or synthesized oil comprising:

A) triglycerides containing fatty acids of only 20 carbons or less, or

B) an ester made from a fatty acid and an alcohol; and 2) an essential oil; and a sulfur-containing sulfide mineral flotation promoter selected from the group consisting of xanthates, thionocarbamates, dithiophosphates, mercaptans, and combinations thereof;

c) selectively floating the mineral sulfide by injecting air and selectively allowing the mineral sulfides to adhere to the air bubbles; and d) removing the mineral.

2. The method according to claim 1, wherein said mineral sulfide-containing material is selected from the group consisting of chalcocite, chalcopyrite, bornite, sphalerite, pentlandite, molybdenite, and other sulfide minerals containing silver, gold, platinum, palladium, iridium, rhodium, or osmium, either in the crystal structure or in association as an independent mineral species, and combinations thereof.

3. The method according to claim 1, wherein said mineral sulfide-containing material is derived from ores, concentrates, precipitates, residues, tailings, slags, or wastes.

4. The method according to claim 1, wherein the essential oil comprises a compound selected from the group consisting of a terpene compound, an aromatic compound, and a combination thereof.

5. The method according to claim 1, wherein the essential oil comprises a terpene derivative having a functional group selected from the group consisting of an alcohol, an ether, an aldehyde, and a ketone.

6. The method of claim 1, wherein said triglyceride further comprises at least one functional group selected from the group consisting of ketones, aldehydes, ethers, and alcohols.

7. The method according to claim 1, wherein the natural oil or the synthesized oil further comprises an aromatic functional group.

8. The method according to claim 1, wherein said oil and said sulfur-containing sulfide mineral flotation promoter are emulsified.

9. The method according to claim 1, wherein said collector further comprises a frother.

10. The method according to claim 1, wherein said collector further comprises a petroleum-based flotation promoter.

11. The method according to claim 1, wherein said natural oil is selected from the group consisting of cottonseed, corn, linseed, rice bran, safflower, soybean, avocado, jojoba, menhaden, lard, castor, cod liver, tung, oiticicia, apricot, sunflower, pistachio, herring, and coconut; and the essential oil is selected from the group consisting of limonene, citronella, eugenot, eucalyptus globus, camphor, and clove oil.

12. The method according to claim 1, wherein said natural oil is selected from the group consisting of cottonseed, corn, linseed, rice bran, safflower, soybean, avocado, jojoba, menhaden, lard, castor, cod liver, tung, and oliticia; said synthetic oil is 2-butylocytl oleci acid ester; and said essential oil is selected from the group consisting of limonene, citronella, eugenol, eucalyptus globus, camphor, and clove oil.

13. The method according to claim 1, wherein the collector comprises a natural oil selected from the group consisting of cottonseed, corn, linseed, rice bran, safflower, soybean, avocado, jojoba, menhaden, lard, and castor.

14. The method according to claim 1, wherein the collector comprises a natural oil selected from the group consisting of: cottonseed, corn, linseed, rice bran, safflower, and soybean.

15. The method according to claim 1, wherein the collector comprises cottonseed oil.

16. The method according to claim 1, wherein the collector comprises an essential oil.

17. The method according to claim 16, wherein the collector comprises limonene or citronella.

18. The method according to claim 1, wherein the collector comprises a synthesized oil.

19. The method according to claim 18, wherein the collector comprises 2-butylocytl oleic acid ester.

20. The method according to claim 1, wherein the collector comprises a blend of two or more of said natural oils, synthetic oils or essential oils.

21. The method of claim 1 wherein the collector is added in an amount less than about 50 g/ton of material.

22. The method of claim 1 wherein the collector is added in an amount less than about 30 g/ton of material.

23. The method of claim 1 wherein the collector is added in an amount less than about 10 g/ton of material.

24. The method of claim 1, further comprising separating the floated mineral sulfide and subjecting the mineral sulfide to a second flotation by repeating (b) and (c).

25. A method for beneficiation of a metallic species of gold, silver, copper, palladium, platinum, iridium, osmium, rhodium or ruthenium by air-injection froth flotation in the presence of a collector, the method comprising:

a) providing an aqueous slurry of a material containing the metallic species, the material being derived from any ore, concentrate, residue, slag, or waste;

b) adding a selective collector to the slurry in an amount less than about 100 g per ton of material containing metallic species, the collector comprising:

at least one oil selected from the group consisting of:

1) a natural oil or synthesized oil comprising:

A) triglycerides containing fatty acids of only 20 carbons or less, or

B) an ester made from a fatty acid and an alcohol; and 2) an essential oil; and a sulfur-containing sulfide mineral flotation promoter selected from the group consisting of xanthates, thionocarbamates, dithiophosphates, mercaptans, and combinations thereof;

c) selectively floating the metallic species by injecting air and selectively allowing the mineral sulfides to adhere to the air bubbles; and d) recovering the metallic species.

* * * * *

UNITED STATES PATENT AND TRADEMARK OFFICE

CERTIFICATE OF CORRECTION

PATENT NO. : 6,827,220 B1
APPLICATION NO. : 09/762619
DATED : December 7, 2004
INVENTOR(S) : Tom L. Young et al.

It is certified that error appears in the above-identified patent and that said Letters Patent is hereby corrected as shown below:

In column 1, line 25, delete "oil," and substitute --oils,-- in its place.

In column 1, line 28, delete "or other" and substitute --or otherwise-- in its place.

In column 1, line 32, delete "techniques" and substitute --technique-- in its place.

In column 1, line 39, after "interest" delete "on" and substitute --in-- in its place.

In column 1, line 42, after "called" delete "out".

In column 1, line 45, delete "$CaCO_2$, $MgCO_2$," and substitute --$CaCO_3$, $MgCO_3$,-- in its place.

In column 1, line 64, delete "extruderoil" and substitute --extender oil-- in its place.

In column 2, line 2, after "water-soluble and" delete "oil" and substitute --oily-- in its place.

In column 2, line 49, delete "specially," and substitute --specialty,-- in its place.

In column 5, line 64, delete "extract" and substitute --exact-- in its place.

In column 6, line 61, delete "46% $C_{1x1}$(oleic acid). 15% $C_{1x2}$(linoleic acid). 1% $C_{1x2}$ (linolenic acid)," and substitute --46% $C_{18:1}$(oleic acid), 15% $C_{18:2}$(linoleic acid), 1% $C_{18:3}$ (linolenic acid),-- in its place.

In column 8, line 48, after "alcohols" delete "have" and substitute --has-- in its place.

In column 9, line 8, after "to as" delete "oil" and substitute --oily-- in its place.

In column 9, line 14, after "such as" delete "coat," and substitute --coal,-- in its place.

In column 9, line 18, after "extender oils" delete "are" and substitute --and-- in its place.

UNITED STATES PATENT AND TRADEMARK OFFICE

CERTIFICATE OF CORRECTION

PATENT NO. : 6,827,220 B1
APPLICATION NO. : 09/762619
DATED : December 7, 2004
INVENTOR(S) : Tom L. Young et al.

It is certified that error appears in the above-identified patent and that said Letters Patent is hereby corrected as shown below:

In column 9, line 21, delete “oil collector” and substitute --oily collector-- in its place.

In column 9, line 58, after “following” insert --are--.

In column 10, line 5, delete “gram/top” and substitute --gram/ton-- in its place.

In column 10, line 55, delete “Ag.” and substitute --Ag,-- in its place.

In column 11, line 19, delete “grams per” and substitute --gram per-- in its place.

In column 11, line 46, after “kilograms” delete “were” and substitute --was-- in its place.

In column 12, line 28, before “shown” insert --are--.

In column 13, line 2, after “grams” delete “were” and substitute --was-- in its place.

In column 13, line 14, delete “specially,” and substitute --specialty,-- in its place.

In column 16, line 27, delete “collector. Cytec” and substitute --collector, Cytec-- in its place.

In column 16, line 29, delete “Cytex,” and substitute --Cytec,-- in its place.

In column 16, line 39, delete “Cytex” and substitute --Cytec-- in its place.

In column 16, line 41, after “The results” insert --are--.

In column 17, line 12, delete “collector. Cytec” and substitute --collector, Cytec-- in its place.

In column 17, line 16 after “grams/ton” delete “or” and substitute --of-- in its place.

In column 18, line 23, after “floated for” delete “thee” and substitute --three-- in its place.

UNITED STATES PATENT AND TRADEMARK OFFICE

CERTIFICATE OF CORRECTION

PATENT NO. : 6,827,220 B1
APPLICATION NO. : 09/762619
DATED : December 7, 2004
INVENTOR(S) : Tom L. Young et al.

It is certified that error appears in the above-identified patent and that said Letters Patent is hereby corrected as shown below:

In claim 1, line 23, delete “removing” and substitute --recovering-- in its place.

In claim 12, line 4, delete “oliticia;” and substitute --oiticicia;-- in its place.

In claim 13, line 3, immediately after “consisting of” insert --:-- (colon).

Signed and Sealed this

Second Day of January, 2007

JON W. DUDAS
*Director of the United States Patent and Trademark Office*